US007571571B1

(12) United States Patent
Mershon

(10) Patent No.: US 7,571,571 B1
(45) Date of Patent: Aug. 11, 2009

(54) SLATWALL PROFILE

(75) Inventor: James Mershon, Ravenna, MI (US)

(73) Assignee: Megawall Corporation, Comstock, MI (US)

( * ) Notice: Subject to any disclaimer, the term of this patent is extended or adjusted under 35 U.S.C. 154(b) by 0 days.

(21) Appl. No.: 12/068,585

(22) Filed: Feb. 8, 2008

(51) Int. Cl.

| | |
|---|---|
| ***E04B 2/74*** | (2006.01) |
| ***E04B 2/00*** | (2006.01) |
| ***E04D 1/00*** | (2006.01) |
| ***A47F 5/08*** | (2006.01) |

(52) U.S. Cl. ..... 52/36.5; 52/539; 52/588.1; 52/36.4; 52/592.1; 211/94.01; 403/353

(58) Field of Classification Search ..... 52/36.4, 52/36.5, 529, 539, 542, 546, 547, 588.1, 52/592.1, 177, 536, 483.1; 211/94.01; D25/119, D25/138; 403/353

See application file for complete search history.

(56) References Cited

U.S. PATENT DOCUMENTS

| | | | | | |
|---|---|---|---|---|---|
| 2,019,379 | A | * | 10/1935 | Anderson | 160/235 |
| 3,218,772 | A | | 11/1965 | Martin | |
| 3,368,315 | A | * | 2/1968 | Thurnau | 52/588.1 |
| 3,603,057 | A | | 9/1971 | Curran | |
| D241,396 | S | * | 9/1976 | Copeland | D25/119 |
| 4,155,206 | A | * | 5/1979 | Player | 52/200 |
| 4,603,068 | A | | 7/1986 | Hunter | |
| 4,672,789 | A | | 6/1987 | Fortier | |
| 4,759,159 | A | * | 7/1988 | Blazley | 52/86 |
| 4,961,295 | A | * | 10/1990 | Kosch et al. | 52/36.5 |
| 5,140,793 | A | * | 8/1992 | Knudson | 52/520 |
| 5,170,605 | A | * | 12/1992 | Huddle | 52/588.1 |
| 5,725,201 | A | * | 3/1998 | Parth | 256/24 |
| 5,791,093 | A | | 8/1998 | Diamond | |
| 5,899,344 | A | | 5/1999 | Current et al. | |
| D421,137 | S | * | 2/2000 | Marshall | D25/119 |
| 6,164,467 | A | * | 12/2000 | DePottey et al. | 211/189 |
| 6,360,508 | B1 | * | 3/2002 | Pelfrey et al. | 52/520 |

(Continued)

FOREIGN PATENT DOCUMENTS

| | | | |
|---|---|---|---|
| FR | 2636654 | A1 * | 3/1990 |

(Continued)

*Primary Examiner*—Robert J Canfield
*Assistant Examiner*—Babajide Demuren
(74) *Attorney, Agent, or Firm*—Shlesinger, Arkwright & Garvey LLP

(57) ABSTRACT

A slatwall profile comprises an upper male and a lower female end portions for interlocking with adjacent profiles to create a slatwall panel. The female end portion includes an attachment wall for attachment to a wall structure and a downwardly disposed longitudinal groove formed by the attachment wall, a base wall formed with a substantially 90° corner with the attachment wall, and a U-shaped return that forms a lip. The male end portion is receivable into the groove in an adjacent profile. The male end portion includes a cover wall that overlies the attachment wall in a spaced apart relationship. The cover wall includes a bulge for being positioned adjacent the corner and is configured to support the cover wall a distance away from the attachment wall. The male end portion includes a transverse wall extending from the bulge, the transverse wall for overlaying the base wall. The male end portion includes a ramp wall biased against an inner wall of the return, and a distance between an outer edge of the ramp wall and a bottom of the bulge is larger than a corresponding distance within the groove to provide the male end portion a snug fit within the groove.

12 Claims, 2 Drawing Sheets

U.S. PATENT DOCUMENTS

| | | | | | |
|---|---|---|---|---|---|
| D465,291 | S | * | 11/2002 | Marshall | D25/119 |
| D511,390 | S | | 11/2005 | Schuberth | |
| 6,988,345 | B1 | * | 1/2006 | Pelfrey et al. | 52/519 |
| 2002/0108327 | A1 | * | 8/2002 | Shaw | 52/211 |
| 2004/0079041 | A1 | * | 4/2004 | Bergeron et al. | 52/489.1 |
| 2004/0111980 | A1 | * | 6/2004 | Kosch | 52/36.5 |
| 2004/0187416 | A1 | * | 9/2004 | Grossman et al. | 52/302.2 |

FOREIGN PATENT DOCUMENTS

| | | | | |
|---|---|---|---|---|
| WO | WO 9410404 | A1 | * | 5/1994 |

* cited by examiner

SLATWALL PROFILE

FIELD OF THE INVENTION

The present invention is generally directed to a slatwall panel and in particularly to a profile formed from sheet material, such as metal.

BACKGROUND OF THE INVENTION

Slatwall panels are used to organize or display articles on a wall. Slatwall panels have grooves or slots which are designed to interlock with hooks, shelving brackets and other standard hardware from which the articles are directly hung or which provide support for shelvings on which the articles are placed.

SUMMARY OF THE INVENTION

The present invention provides a slatwall profile a number of which is joined together to form a slatwall panel.

A slatwall profile comprises an upper male and a lower female end portions for interlocking with adjacent profiles to create a slatwall panel. The female end portion includes an attachment wall for attachment to a wall structure and a downwardly disposed longitudinal groove formed by the attachment wall, a base wall formed with a substantially 90° corner with the attachment wall, and a U-shaped return that forms a lip. The male end portion is receivable into the groove in an adjacent profile. The male end portion includes a cover wall that overlies the attachment wall in a spaced apart relationship. The cover wall includes a bulge for being positioned adjacent the corner and is configured to support the cover wall a distance away from the attachment wall. The male end portion includes a transverse wall extending from the bulge, the transverse wall for overlying the base wall. The male end portion includes a ramp wall biased against an inner wall of the return, and a distance between an outer edge of the ramp wall and a bottom of the bulge is larger than a corresponding distance within the groove to provide the male end portion a snug fit within the groove.

DETAILED DESCRIPTION OF THE INVENTION

Figure 1:
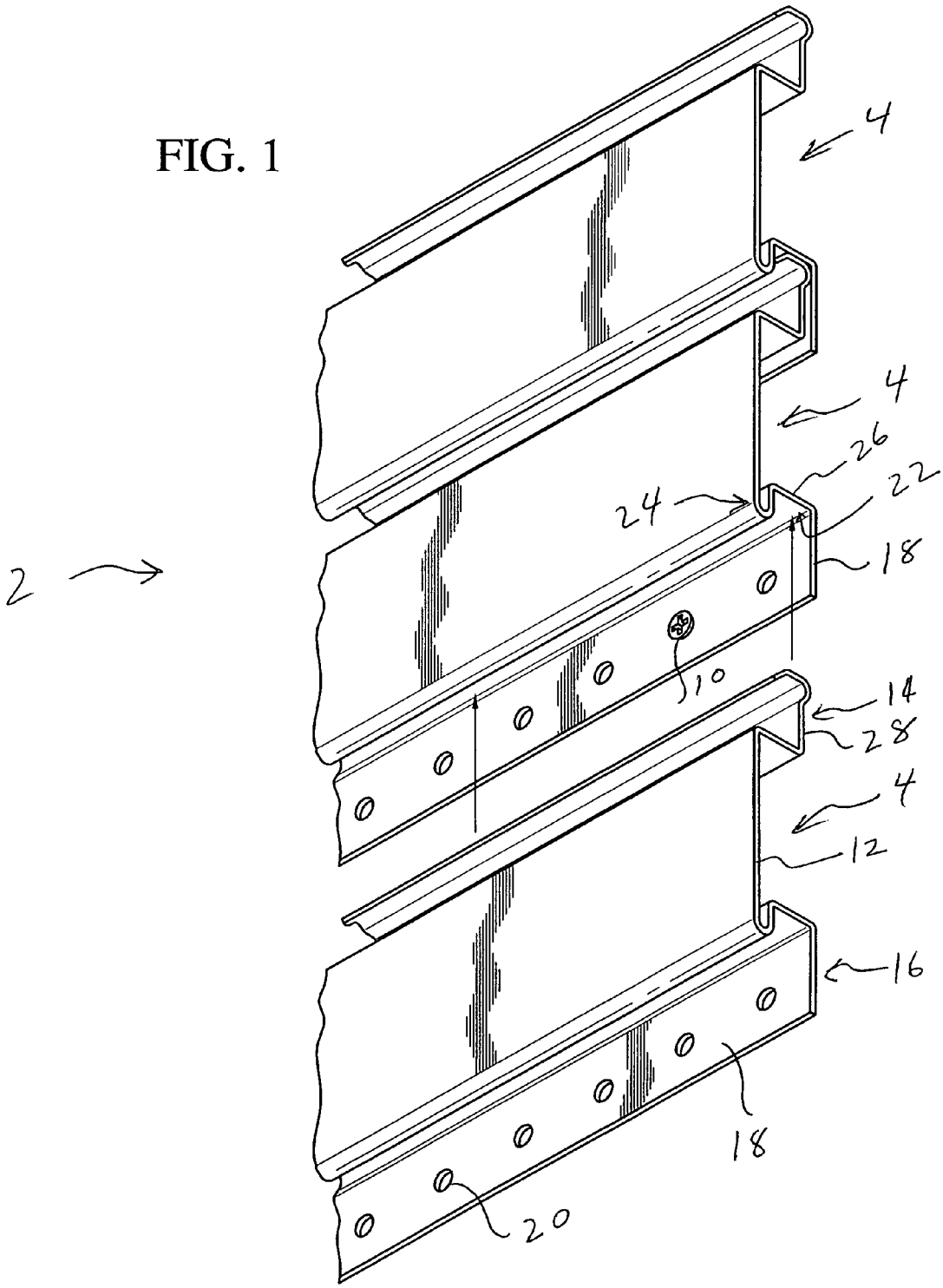
FIG. 1 is a fragmentary perspective view of a slatwall panel, showing one profile in the process of being attached secured to another profile.
Figure 3:
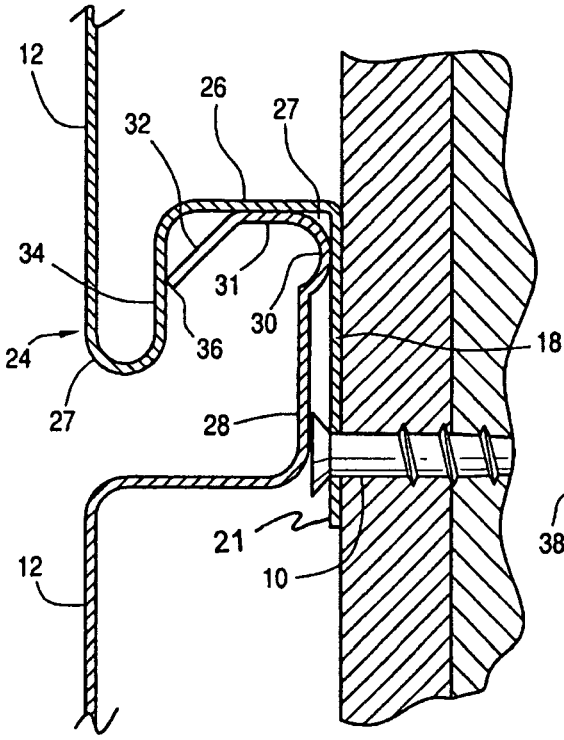
FIG. 3 is an enlarged cross-sectional view of the inter-engagement between two profiles.
Figure 2:
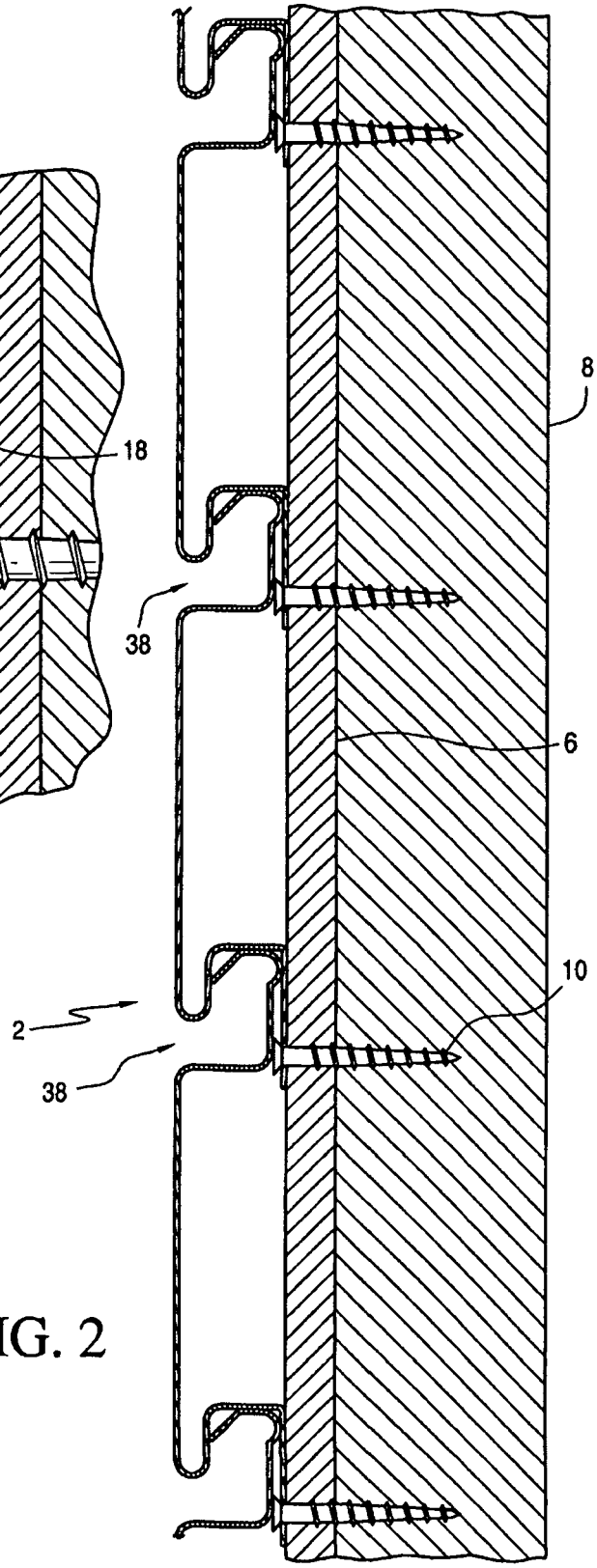
FIG. 2 is a cross-sectional view of an assembled slatwall panel, using a plurality of profiles embodying the present invention.

A slatwall panel 2 embodying the present invention is disclosed in FIGS. 1, 2 and 3. The slatwall panel 2 comprises a plurality of longitudinal profiles 4 formed from sheet material, preferably sheet metal for greater strength. The slatwall panel 2 may be attached to an existing wall, such as wallboard 6, which in turn is attached to wall studs 8 or other wall structures. The slatwall panel 2 may also be attached directly to the studs 8. Standard securing hardware, such as screws 10 may be used for securing the slatwall panel 2 to the wall structure.

Each profile 4 has a front face wall 12, an upper male end portion 14 and a lower female end portion 16. The female end portion 16 has an attachment wall 18 with a plurality of holes 20 for use in attaching the profile to the wall structure with the screws 10. The attachment wall 18 terminates at a terminal outer edge 21. The female end portion 16 further includes a downwardly disposed longitudinal groove 22 defined between the attachment wall 18 and a U-shaped return 24 extending from the front face wall 12. The return 24 forms a lip 27. The groove 22 includes a base wall 26 bent to a substantially 90° angle corner 27 with the attachment wall 18.

The male end portion 14 is receivable into the groove 22 of the female end portion 16, as best shown in FIG. 3. The male end portion 14 includes a cover wall 28 that overlies the attachment wall 18 in a spaced apart configuration to accommodate portions of the screws 10 that extend above the surface of the attachment wall. The cover wall 28 is substantially parallel to the attachment wall 18. A longitudinal bulge 30 provides a transition from the cover wall 28 to a transverse wall 31 bent to a substantially 90° angle with respect to the cover wall 28. The transverse wall 31 is substantially parallel to the base wall 26. The bulge 30 engages a portion of the attachment wall 18 adjacent the corner 27 to support the cover wall 28 in the spaced apart relationship with the attachment wall 18. The male end portion 14 terminates into a longitudinal ramp wall 32 that makes an angle with the wall 31 and an inner wall 34 of the return 24. The ramp wall 32 is bent so as to push against the inner wall 34 and push the bulge 30 against the attachment wall 18, thereby providing a snug fit within the groove 22. The inner wall 34 is substantially parallel to the attachment wall 18.

The ramp wall 32 is preferably angled with respect to the transverse wall 31, for example substantially at 135°, such that its outer edge 36 presses against the inner wall 34 when inserted into the groove 22. The profile 4 is made from sheet metal or other resilient material to provide the ramp wall 32 with spring-like characteristics when positioned within the groove 22. The distance between the outer edge 36 of the ramp wall 32 and the bottom 38 of the bulge is slightly larger than the corresponding distance within the groove 22 to achieve a frictional fit within the groove 22.

The spacing between the cover wall 28 and the attachment wall 18 allows use of screws whose heads may extend above the top surface of the attachment flange 18. The cover wall 28 hides the screw heads from view to provide a finish appearance.

The profile 4 may be roll-formed from sheet material, such as 22 gauge galvanized of cold rolled steel to any desired length. The profiles 4 once installed hide the screws or fasteners 10 from view to create a finished wall. The profiles 4 may be appropriately finished, such as by painting, anodizing, polishing, etc. to provide an attractive appearance.

For installation, starting at the top of the wall, a first profile 4 is leveled and screwed to the wall structure using the pre-punched holes 20 along the attachment wall 18. The male end portion 14 and the female end portion 16 are directed upwardly and downwardly, respectively. A second profile 4 is then attached by pushing the male end portion 14 into the groove 22 of the female end portion 16 of the installed profile. The ramp wall 32 provides a snug fit for the male end portion 14 within the groove 22 of the attached profile. The second profile 4 is then screwed into the wall structure along the attachment wall 18. The screws on the first profile are covered by the cover wall 28 of the second profile. The processes is then repeated until the desired amount of slatwall panel is installed.

The slatwall panel 2 provides a plurality of longitudinal "L"-shaped slots 38 from which several standard hardware are hung for supporting articles on the slatwall panel.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A slatwall profile, comprising:

a) upper male and lower female end portions for interlocking with adjacent slatwall profiles to create a slatwall panel;

b) said female end portion including an attachment wall for attachment to a wall structure;

c) said female end portion including a downwardly disposed longitudinal groove formed by said attachment wall, a base wall formed with a substantially 90° corner with said attachment wall, and a U-shaped return that forms a lip;

d) said male end portion for being receivable into said groove in an adjacent slatwall profile when the slatwall panel is assembled;

e) said male end portion including a cover wall for being positioned over said attachment wall in the adjacent slatwall profile when the slatwall panel is assembled;

f) said male end portion including a bulge for being positioned adjacent said substantially 90° corner in the adjacent slatwall profile when the slatwall panel is assembled, said cover wall extending downwardly from said bulge;

g) said male end portion including a transverse wall extending from said bulge, said transverse wall for being disposed below said base wall in the adjacent slatwall profile when the slatwall panel is assembled; and h) said male end portion including an edge portion turned downwardly for being biased against an inner wall of said return in the adjacent slatwall profile when the slatwall panel is assembled to provide said male end portion a snug fit within said groove between said substantially 90° corner and said inner wall.

2. A slatwall profile as in claim 1, wherein said profile is made from sheet metal.

3. A slatwall profile as in claim 1, wherein said attachment wall includes a plurality of holes.

4. A slatwall profile as in claim 1, wherein said inner wall is substantially parallel to said attachment wall.

5. A slatwall profile as in claim 1, wherein:

a) said edge portion includes a ramp wall formed at an angle with respect to said transverse wall; and b) said ramp wall includes an outer edge, and a distance between said outer edge and a bottom of said bulge being larger than a corresponding distance within said groove.

6. A slatwall profile as in claim 1, wherein said transverse wall is substantially parallel to said base wall.

7. A slatwall profile as in claim 1, wherein said cover wall is substantially parallel to said attachment wall.

8. A slatwall profile as in claim 1, wherein said bulge is longitudinal.

9. A slatwall profile as in claim 5, wherein said ramp wall is longitudinal.

10. A slatwall profile as in claim 1, wherein said cover wall is spaced apart from said attachment wall in the adjacent slatwall profile when the slatwall panel is assembled.

11. A slatwall profile as in claim 5, wherein said angle is substantially 135° with respect to said transverse wall.

12. A slatwall profile as in claim 1, wherein:

a) said attachment wall includes a terminal outer edge; and b) said attachment wall is flat between said substantially 90° corner and said attachment wall terminal outer edge.

* * * * *